US005582625A

United States Patent [19]

Wright et al.

[11] Patent Number: 5,582,625

[45] Date of Patent: Dec. 10, 1996

[54] CURL-RESISTANT COATED ABRASIVES

[75] Inventors: Howard R. Wright, Clifton Park; Richard Vogel, Saratoga Springs; Richard Sargood, Valley Falls; Gwo S. Swei, East Amherst, all of N.Y.; Jane L. Cercena, Ashford, Conn.

[73] Assignee: Norton Company, Worcester, Mass.

[21] Appl. No.: 456,587

[22] Filed: Jun. 1, 1995

[51] Int. Cl.[6] ..... B24D 11/00

[52] U.S. Cl. ..... 51/295; 51/294; 51/297; 428/283; 428/359; 428/360; 428/361; 451/532

[58] Field of Search ..... 51/294, 295, 297; 428/283, 359, 360, 361; 451/532

[56] References Cited

U.S. PATENT DOCUMENTS

| | | | |
|---|---|---|---|
| 2,958,593 | 11/1960 | Hoover et al. | 51/295 |
| 3,324,609 | 6/1967 | Stein et al. | 451/532 |
| 3,688,453 | 9/1972 | Legacy et al. | 451/532 |
| 4,309,473 | 1/1982 | Minamisawa et al. | 428/292 |
| 4,331,453 | 5/1982 | Dau et al. | 51/298 |
| 4,405,341 | 9/1983 | Jaschek et al. | 51/298 |
| 4,478,610 | 10/1984 | Parekh et al. | 51/298 |
| 5,227,224 | 7/1993 | Ishikawa et al. | 428/360 |
| 5,227,229 | 7/1993 | McMahan McCoy et al. | 428/283 |
| 5,272,000 | 12/1993 | Chenoweth et al. | 428/283 |
| 5,316,812 | 5/1994 | Stut et al. | 428/64 |
| 5,482,756 | 1/1996 | Berger et al. | 428/283 |

FOREIGN PATENT DOCUMENTS

| | | | |
|---|---|---|---|
| 92/09331 | 7/1993 | WIPO | B24D 11/00 |

*Primary Examiner*—Deborah Jones
*Attorney, Agent, or Firm*—David Bennett

[57] ABSTRACT

A coated abrasive backing material is provided which is suitable for heavy duty grinding applications is provided by a continuous solid resin matrix having dispersed therein an essentially isotropic fibrous web. The invention also provides a coated abrasive based on said backing.

22 Claims, 1 Drawing Sheet

CURL-RESISTANT COATED ABRASIVES

BACKGROUND OF THE INVENTION

This invention relates to coated abrasives such as abrasive belts and discs, and particularly to curl-resistant coated abrasives that are particularly adapted for use in applications in which the material is subject to very high levels of stress during use.

The applications for which these coated abrasives are designed are those in which excellent non-directional strength properties and the ability to absorb sudden stresses during use are important. An example would be an abrasive disc adapted for coarse grinding applications. It is foreseen however that the coated abrasive might also have applications in forms other than such discs.

Referring specifically to abrasive discs for the purposes of illustration, coated abrasives should preferably have isotropic physical properties, particularly tensile strength, in all directions in the plane of the disc. For the purposes of this application a tensile strength variation in the plane of the disc of not more than about 30% is considered "isotropic" and a disc with a tensile strength variation in the plane of the disc of not more than about 10% is considered to be "highly isotropic".

Discs for typical heavy duty grinding purposes should also preferably have the capability of absorbing impact energy such as might result if the edge of the disc is snagged and should exhibit dimensional stability, that is they should not warp or curl when heated or cooled or subjected to varying humidity conditions.

In the past this application niche has been occupied by coated abrasives using a vulcanized fiber backing material which exhibit generally satisfactory properties except that they often lack the ability to stand up to the heaviest grinding conditions and are frequently subject to severe loss of dimensional stability when heated during manufacture or use.

The present invention provides a coated abrasive that can be produced in the form of discs meeting all these desirable criteria, including dimensional stability, at a level that meets or, more often, excedes that of conventional products.

It is also an objective of this invention to provide abrasive discs that are erodable, that is to say discs that are provided with backings that can be worn away at essentially the same rate as the abrasive grains coated on the backings such that the discs can be used in angle grinding applications until the diameter of the disc has been reduced by a significant percentage, (about 10% or more), of the original diameter. This is essentially a function of the tensile strength and the isotropic character of the backing and the strength of the bond between the backing and the abrasive-containing layer.

General Description of the Invention

In one aspect the invention comprises an isotropic backing material comprising from about 5% to about 50% by weight of randomly oriented fibers bonded by a thermoset resin, the volume ratio of matrix resin composition, (which includes the resin and any fillers incorporated therein), to fiber being from about 1:3 to about 30:1. The tensile strength of the backing in any direction in the plane of the backing is at least 45 MPa and preferably at least 50 MPa.

In a further aspect the invention comprises a dimensionally stable coated abrasive product. The dimensional stability, as the term is used herein, is determined by cutting a disc with a diameter of 23 cm from the coated abrasive and then subjecting this disc to a humidity cycling between 20% and 90% at room temperature for about 2 hours. If the coated abrasive demonstrates "dimensional stability" after this treatment no point on the surface will be more than 2.5 cm above or below the plane of disc at its center point and the curvature, if any, will leave the abrasive on the convex surface.

In a further aspect the invention provides an erodable coated abrasive disc comprising an isotropic backing and an abrasive layer deposited thereon.

In a further aspect the invention provides a coated abrasive product comprising randomly oriented fibers bonded by a thermosetting resin, said product having a minimum tensile strength of at least about 45 and preferably at least about 50 MPa.

The resin is preferably present as a matrix and this implies that the resin forms a continuous structure in which the fibers are dispersed rather than merely as a bond linking the fibers together. In the preferred products according to the invention the resin composition, (which includes the resin along with any fillers incorporated therein), represents from about 50 to about 95% and more preferably from about 75 to 90% of the volume of the backing material though lesser amounts of resin may be used without departing from the essential scope of the invention.

The resin composition preferably comprises a filler such that the volume proportion of the resin itself in the preferred formulations is from about 25 to about 65% of the weight of the backing material and more preferably from about 35 to about 45% of the backing weight.

While the resin composition provides a matrix, this need not imply that the fibers are individually dispersed within the resin. Indeed preferred products according to the invention may be made by impregnating a fibrous mat with the resin composition so as to provide a continuous matrix within the fibrous mat.

The backing is isotropic in nature and this derives principally from the orientation of the fibers in the mat. To secure the isotropic nature of the backing, it is possible to lay down a fiber mat that is truly without directionality, that is, with no predominant orientation for the fibers. This is difficult to obtain in practice so it is often preferred to lay a number of thin scrims each with some residual, (or even full), directionality on top of one another with the angles of directionality of succeeding scrims varying around the compass such that, overall, the laminate formed from the scrims lacks directionality. For example three scrims with a clear directionality can be laid on top of one another with the directionality of each at an angle of 120° to that of both of the other scrims. Isotropy in the fibrous mat will be translated to isotropy in the backing itself since the resin has no preferred orientation. Thus the test for isotropy can equally be applied to the backing material to which the abrasive-containing layer is adhered or to the mat which is used to form the backing material.

Abrasive discs according to the invention retain their shape very well and this is principally demonstrated by the fact that they have a significantly reduced degree of curl. In addition they do not readily shed abrasive grain from the edges during use. As a result the disc can be used for a much longer time in angle grinding applications, with the edge wearing away to expose new cutting grains as grinding proceeds. Thus an operation in which the wear occurs predominantly at the edges of the disc can be continued for much longer, provided that any backing pad used permits operation with discs of reduced diameters or if reduced-size backing discs are periodically substituted. Often however the backings of the discs will have such high tensile strengths and dimensional stability that no backing disc is needed and the issue does not arise.

DETAILED DESCRIPTION OF THE INVENTION

Figure 1:
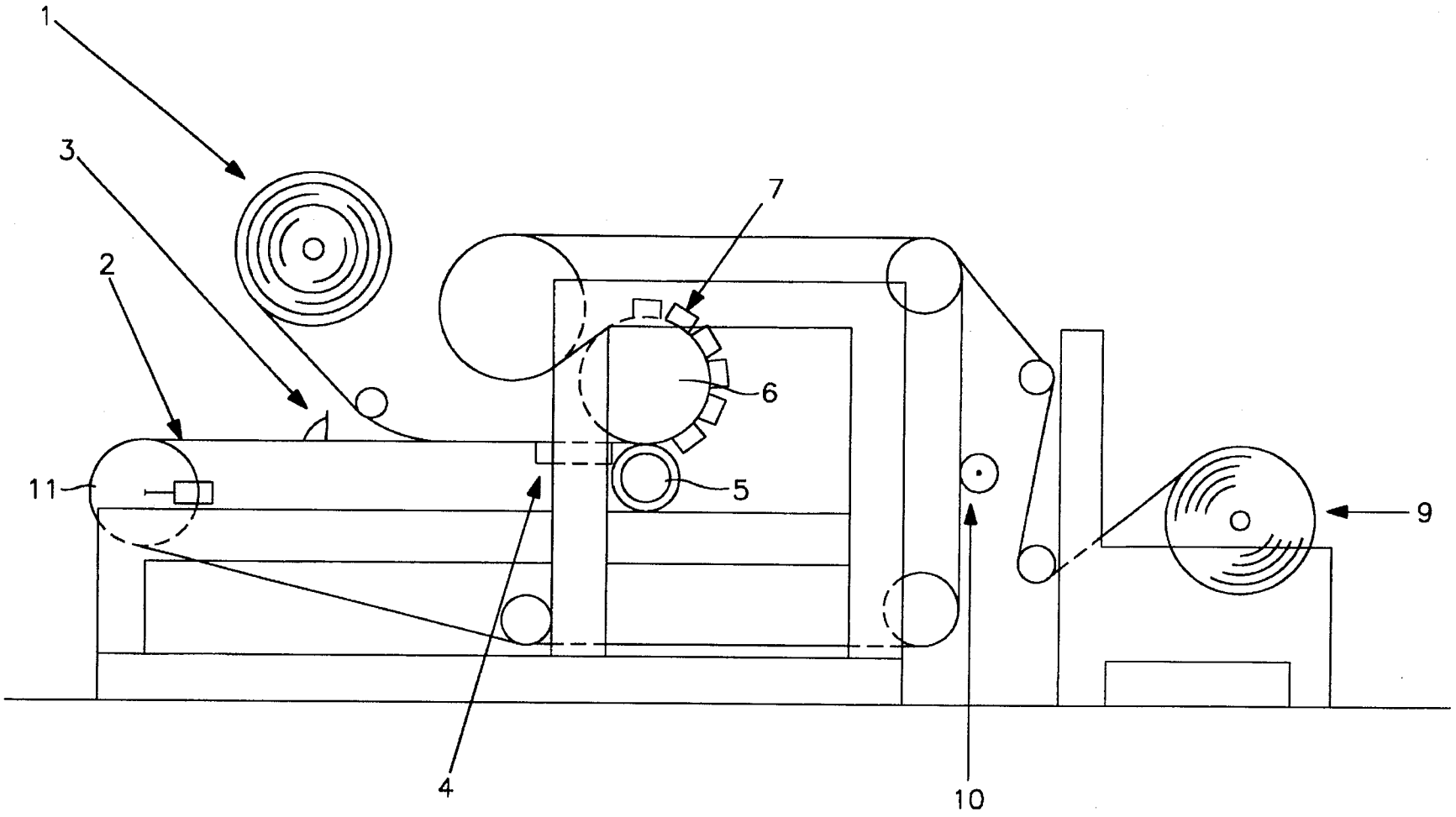

Randomly oriented fiber materials can be randomly air tangled and laid as a web on a foraminous surface. This ideally leads to a completely isotropic web but, as indicated above, in reality some minor directionality is encountered since the deposition surface is typically in motion.

The fibers used can be staple fibers with an aspect ratio, (the ratio of the length to the diameter), that is preferably above about 20, preferably more than about 50 and most preferably more than about 300. The web may be laid down in a single operation or, where there is a residual directionality as a result of the manner of lay-down, a laminate can be formed from a plurality of webs with their directionalities evenly distributed to give a laminate that is essentially isotropic. Strength and isotropy can often be improved by needle-felting the web.

The tensile strength of a composite comprising randomly oriented fibers in a brittle matrix is determined according to the following formula:

$$T_c = \frac{T_f \cdot V}{2}\left(1 - \frac{L_c}{L}\right)$$

for products in which L is greater than $L_c$.

In this formula the symbols have meanings as follows:

$T_c$ is the tensile strength of the composite;

$T_f$ is the tensile strength of the fiber;

L is the average length of the fibers; and $L_c$ is the critical length of the fibers. This is the length of fragments formed when a filament of the material is encased in the brittle matrix and subjected to strain until the filament breaks. It is calculated by the formula:

$$L_c = D.T_f/2.S_m$$

where D is the diameter of the fibers and $S_m$ is the shear strength of the matrix. It is highly preferred that the value of L be very much larger than that of $L_c$ since when they are similar, the volume fraction of fiber in the backing must be somewhat larger.

To illustrate this point, to achieve a minimum tensile strength of 50 MPa in an epoxy resin matrix using fibers with a tensile strength of 3.1 GPa, fibers with an aspect ratio of 20 are needed in a volume fraction of 39%. Raising the aspect ratio to 50 lowers the required amount of fiber to about 5%.

Typical tensile strengths of some fibers are as follows:

graphite . . . 1.03 to 3.1 GPa glass fiber . . . 3.03 to 4.6 GPa kevlar 49 (polyaramid) fiber . . . 3.17 GPa In a system of an epoxy resin matrix and graphite fiber, which has an $S_m$ of 84 MPa and a $T_f$ value of 1.03 GPa, the value of $L_c$ for graphite fibers is calculated as 6.13D.

Using these calculations it is possible to calculate that, in order to attain a tensile strength of at least 50 MPa the L/D ratio of the graphite fibers, (the aspect ratio), and the volume proportion of the fibers in the matrix should be as follows:

| Aspect Ratio | Fiber Volume % |
|---|---|
| 20 | 14 |
| 50 | 11 |
| 300 | 10 |

It will be seen therefore that the above formulae permit the calculation of possible variations in the parameters described in order to reach a backing material with the minimum tensile strength.

For some purposes the use of brittle fibers such as glass and carbon fibers imposes restrictions on the products of the invention on account of their limited ability to absorb stress by expnsion. However products reinforced in this way find their utility in other applications where the above considerations are less important.

The isotropic mat used to produce the backing material has a tensile strength of not less than about 45 MPa and more preferably at least 50 MPa and most preferably more than about 55 MPa. Since the mat is isotropic, the tensile strength in any direction in the plane of the mat does not differ by more than 30% from the value in any other direction and preferably does not vary by more than about 15%.

The volume ratio of fiber to resin composition can be from about 0.05:1 to about 3:1 depending on the tensile strength of the fiber and its aspect ratio and preferably from about 0.1:1 to 1:1.

The fibers from which the mat is made can be formed from glass, polyamide, polyaramid, polyester, polyolefin, graphite and the like, as well as mixtures of such fibers. The fibers are laid down in staple form to produce an isotropic fibrous mat or an anisotropic layer that can, as a result of lamination of several such layers each having some degree of anisotropy, be formed into a mat exhibiting overall isotropy in the plane of the mat.

The resin component can be any that meets the physical requirements of strength without excessive brittleness. Generally epoxy based resins are the most satisfactory but other resins such as phenolic resins, cross-inked polyimides, unsaturated polyesters, polyurethanes and the like may be employed. The preferred resins are epoxy-based resins that cure quickly at temperatures below those at which the fibers comprising the mat impregnated by the resin are susceptible to damage. Generally cure temperatures below about 250° C. and more preferably below about 200° C. are desirable.

The resin should preferably cure quite quickly such that it can be used in an in-line process. This implies a gel time for the preferred epoxy resins in the order of a few minutes such as for example from about 1 to 10 minutes at an appropriate temperature.

The resin composition may also comprise filler materials, such as calcium carbonate, as well as the conventional cross-linking agents, catalysts and solvents that are well-known in the context of the wet application of resin formulations. Generally an excessive amount of a filler such as calcium carbonate can result in slower penetration of the substrate, especially if it is somewhat lumpy. It is desirable therefore to ensure that any filler is dry and free-flowing. It is also found that, particularly with phenolic resins, some additives such as magnesium oxide and zinc oxide speed up the cure of the resin. When phenolic resins are used therefore, these additives can confer special advantages in terms of cure time.

The preferred coated abrasives of the invention are built upon backing materials that have a relatively low void fraction of from 0 to about 20% by volume, with values at the lower end of this range such as from about 5 to about 10% being generally preferred. The voids can be air or gas filled. In some cases it may be desirable to form the voids by decomposition of a void former during the curing of the resin. Usually however the natural porosity of the mat is sufficient to provide any desired level of porosity.

Techniques for obtaining a high level of penetration of the fibrous mat such as is desirable for the preferred backing materials are well-known in the art and include for example laying the fibrous mat in a layer of the uncured resin and applying a further resin coating on top of the web, allowing a partial cure and then passing the resin/mat combination through the nip of at least one set of rollers so as to force the still-fluid resin into the interstices of the mat and form a continuous phase within the resultant backing.

The tensile strength of the backing is measured by the ASTM D-638 using strips of the backing cut at a variety of orientations in the plane of the disc.

DRAWING

FIG. 1 is a schematic drawing showing the general design of a machine capable of producing the abrasive material of the invention from which appropriately shaped coated abrasives may be cut. This machine was essentially the same as that used to produce the abrasive discs evaluated according to the Examples reported below.

DESCRIPTION OF PREFERRED EMBODIMENTS

A suitable machine for the production of abrasive materials according to the present invention appears in FIG. 1. In that drawing, a roll of a non-woven fibrous mat, 1, is unrolled and fed into contact with a stainless steel conveyor belt, 2, supplied with a coating of a lubricant or a release agent, so as to contact said belt at a point after a resin composition has been applied to the belt surface at a resin application station by means of a blade applicator, 3. The mat and resin then pass through a heater device, 4, which preheats the resin before it the resin and mat pass through the nip between a nip roll, 5, and a heated roll, 6. This has the effect of forcing the resin into the interstices of the fibrous mat so as to form a continuous matrix. As the resin impregnated mat passes around the heated roll it is subjected to infra-red heaters that cure the resin and form the backing material. This backing material is stripped from the conveyor belt and wound on wind-up roll, 9. Meanwhile the conveyor belt, 1, passes over a cleaner roll, 10, to remove any traces of resin before passing over a roll having a tensioning device, 11, maintaining the belt at an appropriate tension. From there the belt moves again to the resin application station described above.

The backing can then subjected to conventional, optional back and front fill operations before a maker coat is applied to one surface followed by a layer of abrasive grits. Following at least partial cure of the maker coat, a size coat is conventionally applied over the grits. When fully cured the product is a coated abrasive according to the invention.

The invention is now described with particular reference to the following Examples which are for the purpose of illustration only and are intended to imply no necessary limitations on the essential scope of this invention.

EXAMPLE 1

A polyester fiber material having a denier of 1.5, a 45% elongation at break and a staple length of 3.8 cm was formed into a mat with a weight of 380 gm/m$^2$ and a thickness of 9.5–12.7 mm. The tensile strength, which was approximately the same in both machine and cross directions, was 50.5 MPa.

A matrix resin to form the bond in the backing was formed by blending: 38.27% of Epon 828, (a condensation product of bisphenol A and epichlorohydrin available under that trade name from Shell Chemical Co.); 2.88% of Mondur XP-743, (an isocyanate available from Miles Inc.); 9.57% of isophorone, (a solvent); 1.43% of DMP-30, (2,4,6-tri(dimethylamino-methyl) phenol, a catalyst available from Rohm and Haas Corp.); and 47.85% of Atomite, (a calcium carbonate filler available under that trade name from ECC International), all percentages being by weight.

A backing material was made from the above resin composition and fibrous sheet using the machine described in the FIG. 1. The resin composition was deposited in an amount equivalent to a thickness of about 0.75 mm The belt speed was 61 cm/minute, (2 ft/minute), the gauge pressure at the nip was 0.86 MPa, and the tension on the belt was maintained at 6.89 MPa. The drum was heated to about 143° C. and the infra-red heaters raised the belt and the resin impregnated sheet to a temperature of about 127° C.

The knife blade resin applicator was set with a knife gap of 0.74 mm, and resulted in a resin composition addition to the sheet of 0.68 kg/m$^2$ (20 ounces/square yard). The thickness of the finished backing material was about 0.81 mm and the total weight of the backing material product obtained was 1.22 kg/m$^2$ (80 lbs/sandpaper maker's ream). The resin composition provided about 49% of the volume of the finished backing material and the fibers of the sheet provided about 51%.

The thickness of the backing material product was about 0.81 mm, only slightly thicker than the thickness of the film of resin applied to the mat at the beginning of the process, indicating that the mat had been compressed such that the resin occupied essentially all the void space in the mat after it passed through the nip.

The above backing was used to produce abrasive discs that performed very well under heavy stress grinding conditions. The discs are in fact both dimensionally stable and erodable as the terms are used herein.

EXAMPLE 2

In this Example the performance of an abrasive disc according to the invention was compared with the performance of an otherwise identical conventional disc having a backing made from vulcanized fiber materials. The comparison material was a commercially available disc, sold by Norton Company under the designation "F826". The application on which the discs were tested was the removal of excess epoxy resin and phenolic-cloth composite from insulated rail joints. The abrasive grain on each was an alumina-zirconia abrasive grain and the backing on the F826 disc was made from vulcanized fiber with standard back- and front-fill operations.

In normal operations using the F826 disc, 20–25 joints can be finished before the disc is no longer usable, usually as a result of flex fatigue of the backing. With the abrasive disc according to the invention, 43 joints had been finished before the test was terminated. The disc still had considerable useful life when the test was terminated for reasons unconnected with the performance of the disc. The discs to be tested were mounted on an Ingersoll-Rand HD air-powered disc grinder operated at 6000 rpm. The discs were mounted on a 5 inches diameter rubber back-up pad which already carried two used conventional vulcanized fiber discs with diameters of six and seven-sixteenths inches.

During the test, the diameter of the disc decreased from seven inches to six and thirteen-sixteenths inches. Although there was a limited amount of cracking in the grain coating, these cracks did not propogate into the backing. No grain shedding had occurred. That were therefore "erodable" as the term is used herein.

Five used F826 discs were examined to establish the predominant failure mode. Each disc was worn to a six and five-sixteenths inches diameter and showed some grain shedding. There was considerable evidence of flex fatigue failure and one was torn at the periphery indicating that some snagging had occurred.

New F826 discs sometimes have significant curl with the abrading surface inside due to inadequate curl correction. Unused discs according to the invention showed dimensional stability and in fact had only a slight curl with the abrading surface outside.

The usual rail-grinding technique, (as indicated above), is to apply new discs over the top of the old discs. When this is done using the conventional discs of the prior art, remaining grain on the used disc can lead to holes in the back of the new disc. Use of the new discs according to the invention showed no evidence of this kind of wear.

The improved coated abrasive according to the invention was therefore extremely effective in providing a significantly extended useful life for the disc in this application. The improvement cannot be attributed to the grain or the maker or size coats since these were identical. Only the nature of the backing was changed and the improvements are clearly attributable to this substitution.

EXAMPLE 3

In this Example a phenolic resin is used to impregnate a web similar to that used to make the backing material described in Example 1. The impregnation was performed on a 20 cm square sample of the web using plates and a press rather than the arrangement illustrated in the Drawing.

The following composition was formulated:

Phenolic resin (BM-12, available from Allied Signal Bendix) 75 gm

Water . . . 15 gm

60% NaOH solution . . . 19 gm

Calcium Carbonate filler . . . 38 gm

The pH was measured at 11.5. Just before the above solution was applied, 19 gm of a curing agent, ("Alphacure" 910, available under that trade name from Borden), were added with stirring. The addition was performed just before the formation of the laminate because the gel time of the formulation was found to be about 6 minutes. This is highly desirable for the process of forming the backing but requires that the formulation does not spend a lot of time between formation and use.

Two flat aluminum plates were sprayed with a release agent and then air dried. The above phenolic resin formulation was applied to one of the plates using a doctor blade to deposit a layer 0.66 mm thick on the plate. The non-woven backing used in Example 1 was laid on the plate in the form of 20 cm square piece and the second aluminum plate was placed on top to form a sandwich. The sandwich was placed in a press heated to about 93° C. and a pressure of 4,545 kg was applied to the plates for 10 seconds, after which the applied pressure was reduced to zero and the sandwich remained in the press for a further two minutes at the same temperature. This regime was adopted to simulate the condition in the equipment illustrated in the Drawing.

The sample showed excellent resin penetration. The resin had cured and the backing material obtained had smooth and uniform surfaces and showed dimensional stability.

What is claimed is:

1. A coated abrasive comprising a backing material with a tensile strength of at least 45 MPa and comprising a staple fiber mat bonded by a thermoset resin with the resin and fibers present in a volume ratio of from about 1:3 to about 30:1, said backing being isotropic in the plane of the backing and having an abrasive grain-containing layer adhered to a surface thereof to form a coated abrasive exhibiting dimensional stability.

2. A coated abrasive according to claim 1 in which the mat is comprised of staple fibers selected from the group consisting of polyamides, polyaramids, polyesters, polyolefins, carbon, glass and mixtures of such fibers.

3. A coated abrasive according to claim 1 in which the mat is highly isotropic.

4. A coated abrasive according to claim 1 in which the fibers of the mat have an aspect ratio of from about 20 to about 300.

5. A coated abrasive according to claim 1 in which the resin is selected from the group consisting of epoxy resins, phenolic resins, thermoset polyurethanes, unsaturated polyesters and polyimides.

6. A coated abrasive according to claim 1 in which the mat provides from about 5 to about 50% by weight of the backing, the resin provides from about 45 to about 25% of the total backing weight, and the balance is provided by an inert filler.

7. A coated abrasive according to claim 6 in which the inert filler is calcium carbonate.

8. A coated abrasive according to claim 1 in which the tensile strength of the backing material is greater than 50 MPa.

9. A highly isotropic, coated abrasive disc, said disc comprising a backing material having a tensile strength of at least 50 MPa and comprising a staple polyester or polyamide fiber mat bonded by an epoxy resin with the fibers and resin present in a volume ratio of from about 0.05:1 to about 1:3, said backing having an abrasive grain-containing layer adhered to a surface thereof.

10. A coated abrasive disc according to claim 9 in which the volume ratio of fibers to resin is from about 0.1:1 to about 1:1.

11. A coated abrasive disc according to claim 9 in which the fibers have an aspect ratio of from about 20 to about 300.

12. A coated abrasive disc according to claim 9 which exhibits dimensional stability.

13. An erodable, dimensionally stable, isotropic, coated abrasive disc comprising a backing material with a tensile strength of at least 50 MPa comprising a staple fiber mat bonded by a thermoset composition resin with the fiber and resin composition present in a volume ratio of from about 0.05:1 to about 1:1, said backing having an abrasive grain-containing layer adhered to a surface thereof to form a coated abrasive disc.

14. An erodable, dimensionally stable, highly isotropic, coated abrasive disc comprising a backing material having a tensile strength of at least 50 MPa and comprising a staple polyester or polyamide fiber mat bonded by an epoxy resin with the fibers and resin present in a volume ratio of from about 0.1:1 to about 0.75:1, said backing material having an abrasive grain-containing layer adhered to a surface thereof.

15. A backing material for a coated abrasive said backing material having a tensile strength of at least 45 MPa and comprising a staple fiber mat bonded by a thermoset resin with the resin and fibers present in a volume ratio of from about 1:3 to about 30:1, said backing being isotropic in the plane of the backing.

16. A backing material according to claim 15 in which the mat is comprised of staple fibers selected from the group consisting of polyamides, polyaramids, polyesters, polyolefins, carbon, glass and mixtures of such fibers.

17. A backing material according to claim 15 in which the mat is highly isotropic in the plane of the backing.

18. A backing material according to claim 15 in which the fibers of the mat have an aspect ratio of from about 20 to about 300.

19. A backing material according to claim 15 in which the resin is selected from the group consisting of epoxy resins, phenolic resins, thermoset polyurethanes and polyimides.

20. A backing material according to claim 15 in which the mat provides from about 5 to about 50% by weight of the backing, the resin provides from about 45 to about 25% of the total backing weight, and any balance is provided by an inert filler.

21. A backing material according to claim 20 in which the inert filler is calcium carbonate.

22. A backing material according to claim 15 in which the tensile strength in the plane of the backing is greater than 50 MPa.

* * * * *